US006832697B2

(12) United States Patent
Lai

(10) Patent No.: US 6,832,697 B2
(45) Date of Patent: Dec. 21, 2004

(54) PAPER DISPENSER

(76) Inventor: Tun Lai, No. 32, Lane 13, Jingmei 1st St., Taiping City (TW)

( * ) Notice: Subject to any disclaimer, the term of this patent is extended or adjusted under 35 U.S.C. 154(b) by 102 days.

(21) Appl. No.: 10/408,144

(22) Filed: Apr. 7, 2003

(65) Prior Publication Data

US 2004/0195259 A1 Oct. 7, 2004

(51) Int. Cl.[7] ..... B23Q 7/04
(52) U.S. Cl. ..... 221/210; 221/259
(58) Field of Search ..... 221/45, 33, 56, 221/232, 226, 238, 259, 210, 213, 268

(56) References Cited

U.S. PATENT DOCUMENTS 4,796,779 A * 1/1989 Mamolou ..... 221/36
5,197,630 A * 3/1993 Kirla ..... 221/37

* cited by examiner

*Primary Examiner*—Kenneth Noland
(74) *Attorney, Agent, or Firm*—Charles E. Baxley

(57) ABSTRACT

A paper dispenser generally comprises a chassis, an actuating member, a driven member, a paper pusher, an elastic member and a cover as a whole mounted to a paper box. The above-mentioned parts are assembled together so as to provide an interactive effect by pushing actions and paper pusher may push sheets smoothly, such that the user may take out the sheets easily and quickly.

10 Claims, 5 Drawing Sheets

PAPER DISPENSER

BACKGROUND OF THE INVENTION

1. Field of the Invention

The present invention relates to a paper dispenser, and more particularly to a device that is capable of facilitating the dispensation of sheets.

2. Description of the Prior Arts

Most of office people like putting some sheets or memos on the desk for purpose of writing some information down in case of a phone-call or the likes. However, due to there is certain adhesive force between the surfaces of sheets, in their hurry to take the sheets, the users find their difficulties in precisely taking one sheet away from the stacks which usually give rise to the scattered falls of the sheets.

The present invention has arisen to mitigate and/or obviate the afore-described disadvantages of the conventional paper dispenser.

SUMMARY OF THE INVENTION

In accordance with one aspect of the present invention, there is provided a paper dispenser which generally comprises a chassis, an actuating member, a driven member, a paper pusher, an elastic member and a cover as a whole mounted to a paper box. The above-mentioned parts are assembled together so as to provide an interactive effect by pushing actions.

The primary objective of the present invention is to provide a paper dispenser that enables the user to take out sheets easily and quickly.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
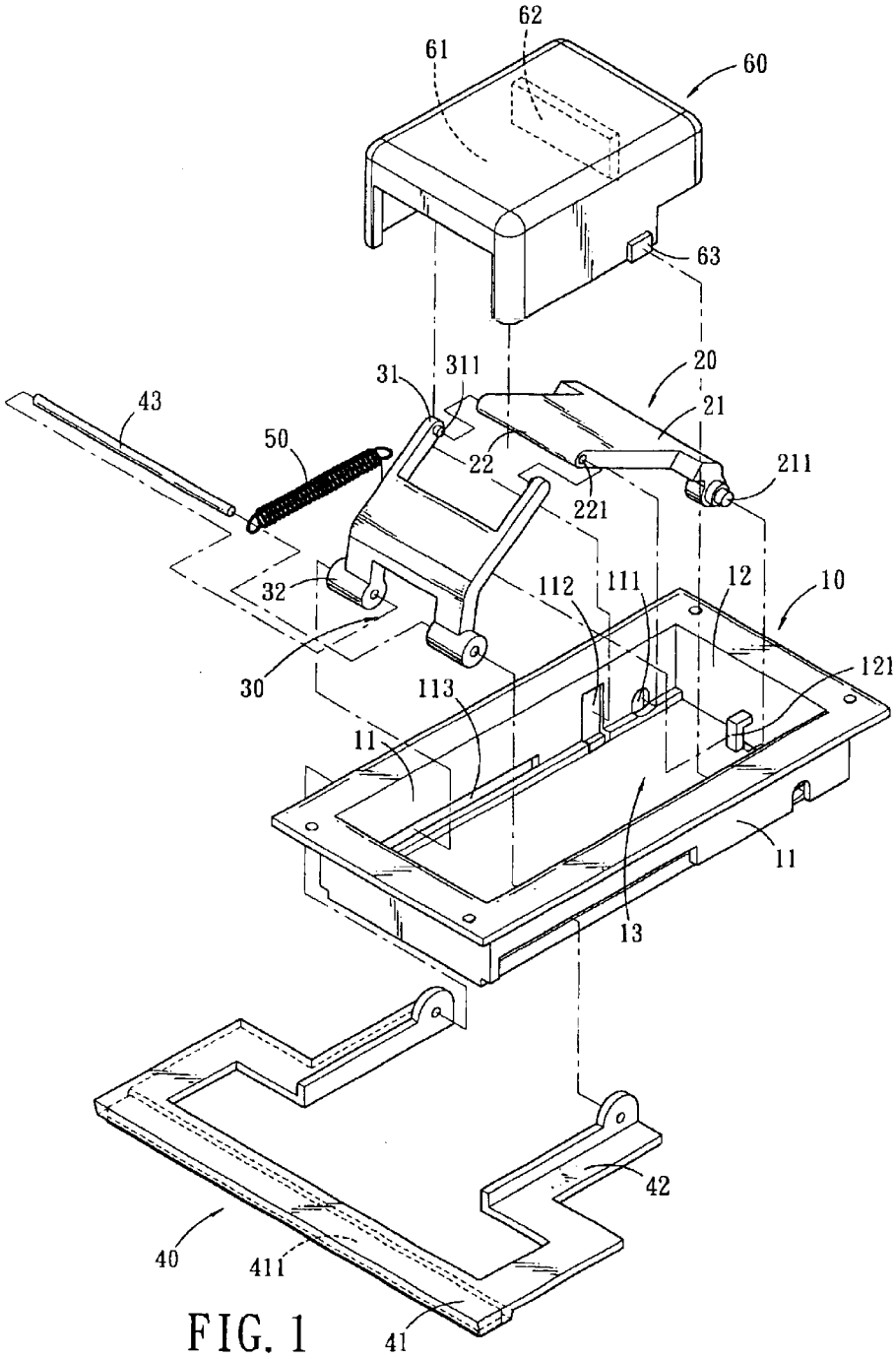
FIG. 1 is an exploded view of a paper dispenser in accordance with the present invention.
Figure 2:
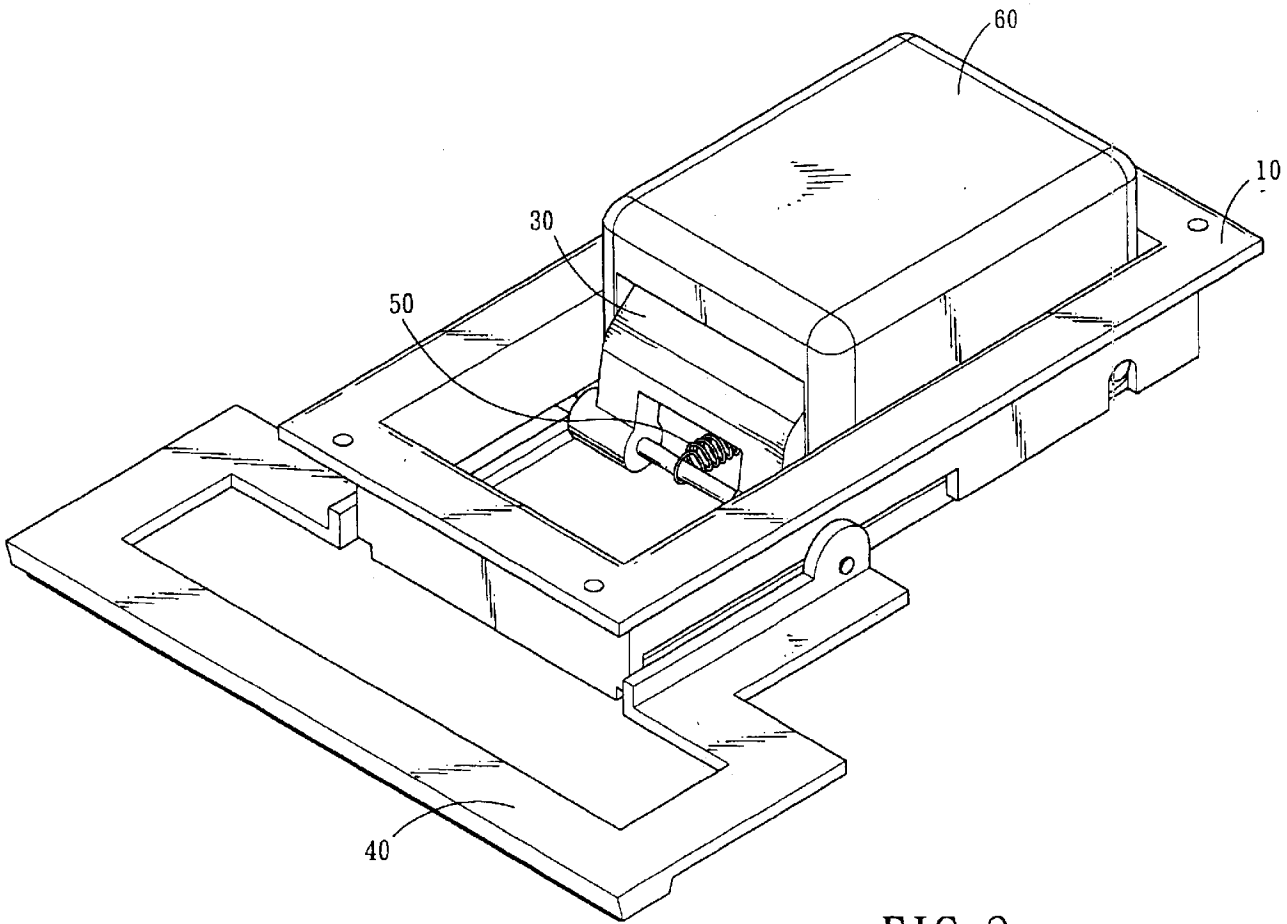
FIG. 2 is a perspective view of the paper dispenser in accordance with the present invention.
Figure 3:
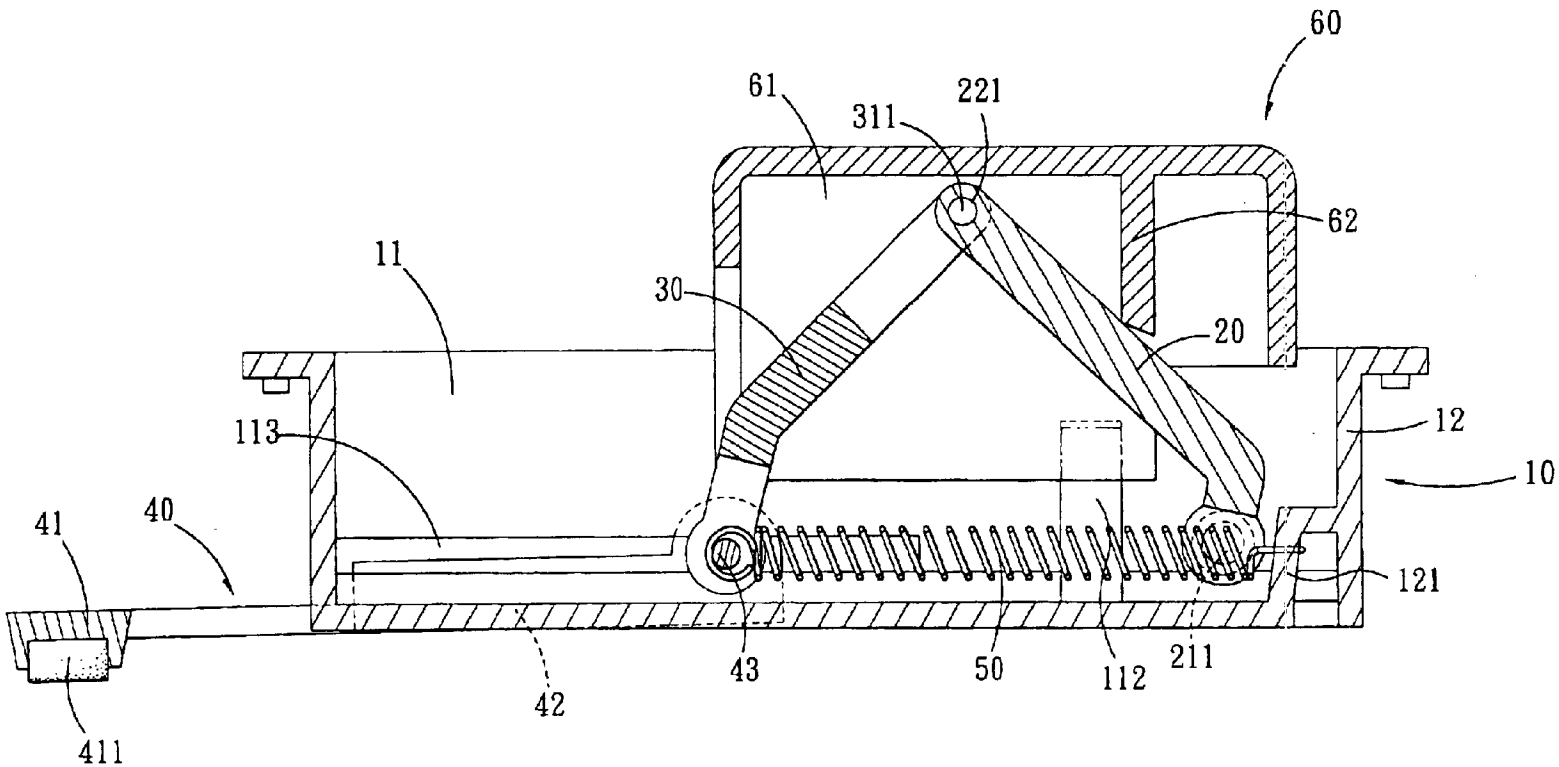
FIG. 3 is a cross sectional view of the paper dispenser in accordance with the present invention.

Referring to FIGS. 1–3, wherein a paper dispenser in accordance with the present invention is shown and generally comprises a chassis 10, an actuating member 20, a driven member 30, a paper pusher 40, an elastic member 50 and a cover 60.

The chassis 10 generally includes a pair of long sides 11 and a pair of short sides 12 defining a space 13 therein. Two holes 111 are defined at each of the long sides 11 with corresponding to each other. In vicinity to each hole 111 a slot 112 is defined with one corresponding to another, and alike, in vicinity to the each slot 112 a strip groove 113 is formed also with corresponding to each other. Moreover, a hook 121 is disposed at a short side 12 where close to the holes 111.

The actuating member 20 has a first and second end 21,22. At the second end 22 recesses 221 are defined while at the first end 21 protrusions 211 are formed and serve to be received in the corresponding holes 111 of the chassis 10 respectively such that the actuating member 20 is permitted to move within the space 13 of the chassis 10.

The driven member 30 is provided with a first end 31 and a second end 32. At the first end 31 lugs 311 are disposed and serve to be received in the recesses 221 of the actuating member 20 respectively. While the second end 32 is corresponding to the strip grooves 113 and allowed to horizontally move in the space 13 of the chassis 10.

The paper pusher 40 includes a pushing portion 41 and at both sides of the pushing portion 41 an arm 42 symmetrically is formed respectively. At the top of the pushing portion 41 a damper 411 is disposed for pushing sheets, while the pair of arms 42 serve to be engaged with the strip grooves 113 by passing a rod 43 through the arms 42, the strip grooves 113 and the second end 32 of the driven member 30 respectively. By such arrangements, the paper pusher 40 is engaged with the driven member 30 and moves along with the movement of the same.

The elastic member 50, here takes spring as example, has a first end connected to the hook 121 of the chassis 10 and a second end connected to the rod 43 such that the driven member 30 can be recovered to the original position by virtue of the elastic member 50.

The cover 60 has a chamber 61 and at the bottom of which a contacting piece 62 is disposed, while at the outer periphery of the cover 60 projections 63 are formed with corresponding to slots 112 of the chassis 10 respectively. The chamber 61 of the cover 60 serves to mount onto the actuating member 20 and the driven member 30 with the contacting piece 62 butting around the center of the actuating member 20 while the two projections 63 received in the slots 112 for purpose of preventing the disengagement of the cover 60 from the chassis 10. By such arrangements, the cover 60 enables the actuating member 20, the driven member 30 and the paper pusher 40 connected in an interactive manner.

Figure 4:
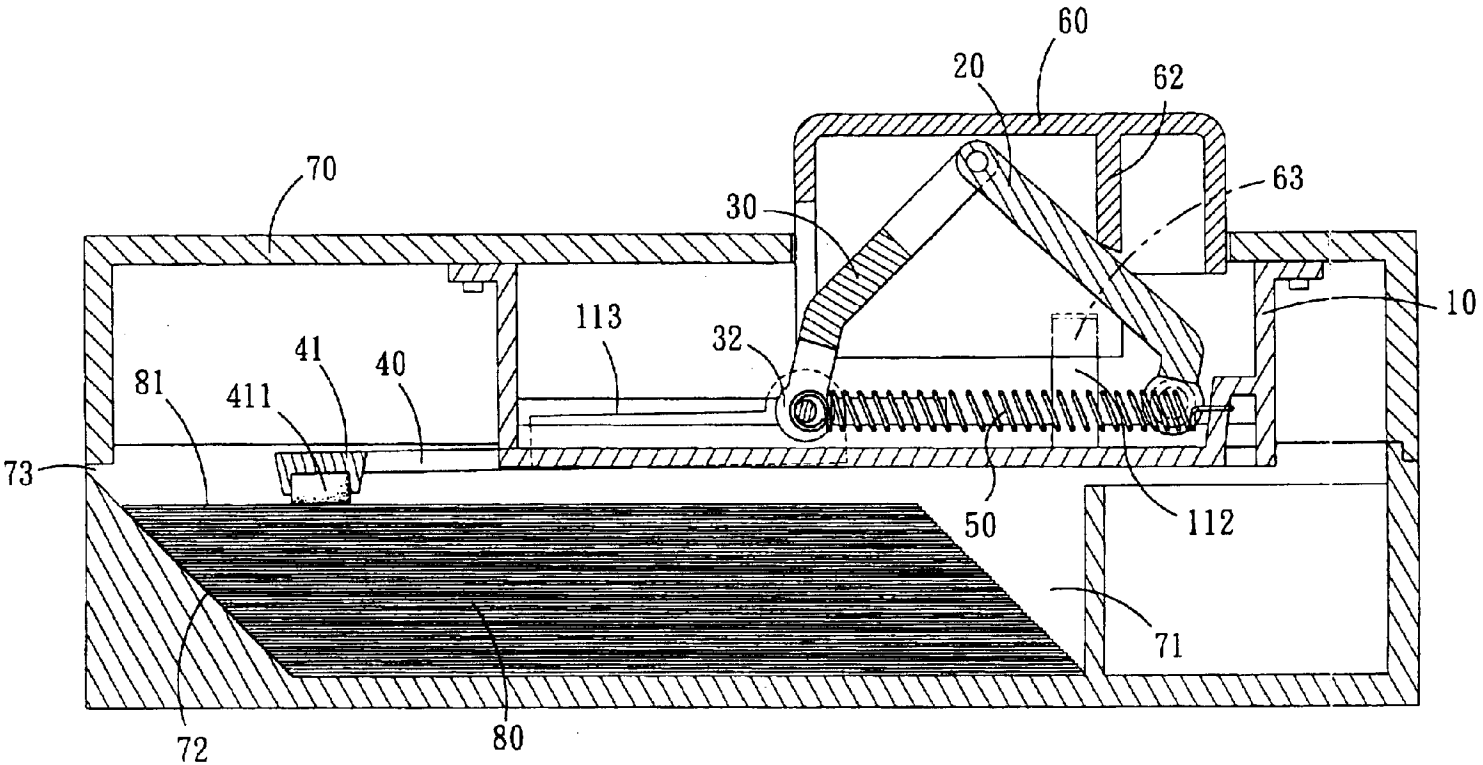
FIG. 4 is a cross sectional view of showing the paper dispenser of the present invention mounted on the paper box.
Figure 5:
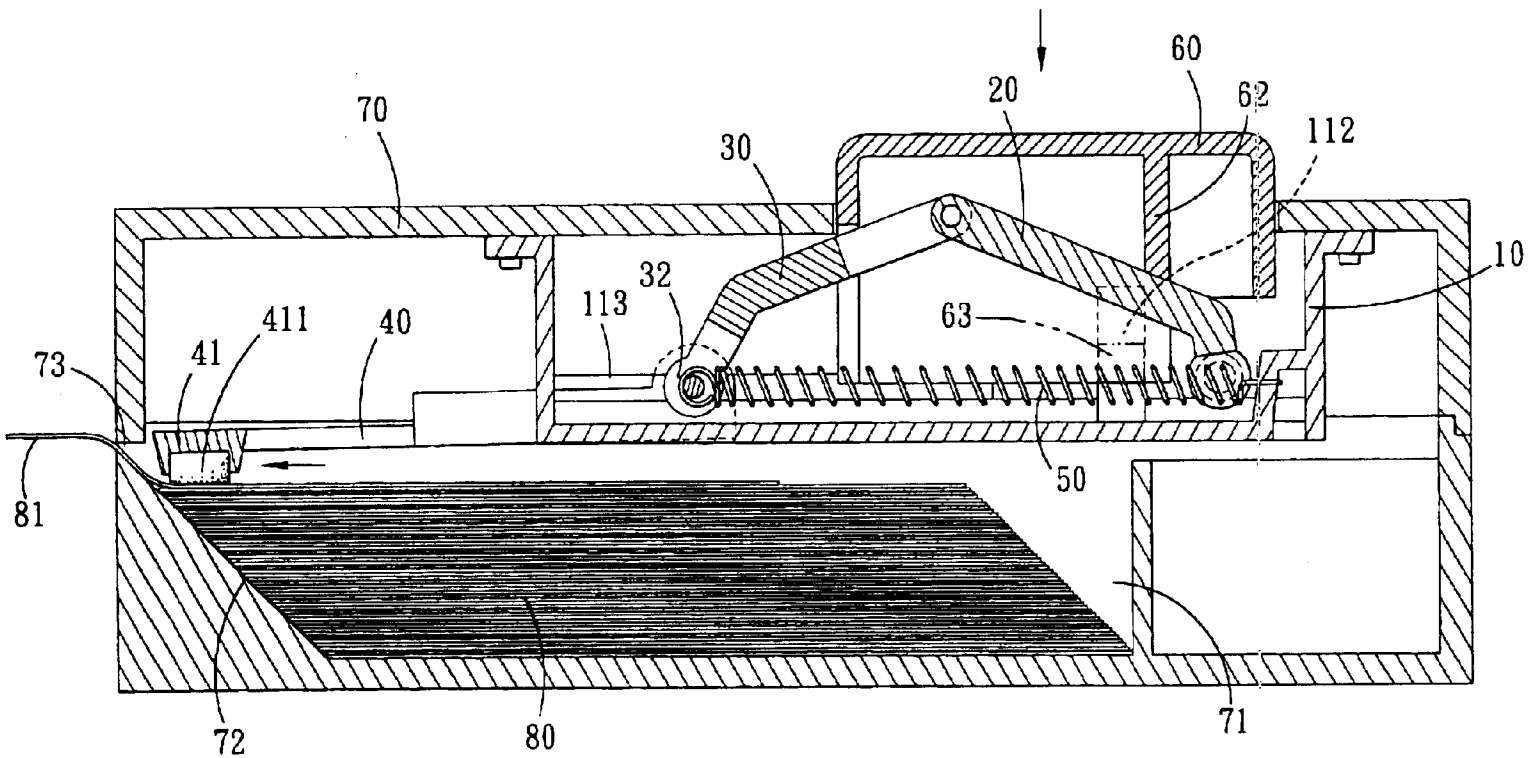
FIG. 5 is another cross sectional view of showing the paper dispenser of the present invention mounted on the paper box.

Referring to FIGS. 4–5, in which, a chassis 10 of the present invention is mounted to the paper box 70 and the paper box 70 interiorly formed with a space 71 and a stack of paper 80 is stocked therein. Moreover, the space 71 is provided with a guiding incline 72, and at the top of the space 71 where corresponding to the guiding incline 72 an exit 73 is formed.

After the paper box 70 is mounted thereon, the paper pusher 40 possesses a suitable weight, and the damper 411 contacts with the first sheet 81 of the stack 80. To take out the paper, what the user needs to do is only to push the cover 60 and the same is confined by the slots 112 only longitudinally movable due to the projections 63 of the same are movably received in the longitudinal slots 112 of the chassis 10. And then the cover 60 moves downward with the contacting piece 62 butting the actuating member 20 so as to move the same, which further effects an movement of the driven member 30 since which is connected with the actuating member 20 and the horizontal movement of the second end 32 of the driven member 30 along the strip grooves 113 (namely move towards the exit 73 of the paper box 70). Such that the paper pusher 40 connected to the driven member 30 is driven to move with the damper 411 of the pushing portion 41 pushing the first sheet 81 of the stack 80, thereby the user can take the first sheet 81 that moves out of the exit 73 along the guiding incline 72.

On the other hand, the actuating member 20 moves with relative to the driven member 30 in case that the cover 60 is pushed, which effects a longitudinal expansion movement of the elastic member 50 and a restoring force of the same simultaneously. Such that, in case that the cover 60 is not pressed, the same and the actuating member 20, the driven member 30 and together with the paper pusher 40 are driven back to the original position by the restoring force of the elastic member 50, and wait for the next cycle of movement. By such a manner, the sheets may be taken out easily and quickly.

While we have shown and described various embodiments in accordance with the present invention, it should be clear to those skilled in the art that further embodiments may be made without departing from the scope of the present invention.

What is claimed is:

1. A paper dispenser comprising:

a chassis defining a space therein;

an actuating member having a first and second end, which to be received in the space of the chassis by virtue of the first end;

a driven member having a first end connected with the second end of the actuating member and a second end moving horizontally in the space of the chassis;

a paper pusher having a first end connected with the second end of the driven member and a second end for pushing sheets;

an elastic member having a first end connected to the chassis and a second end connected to the driven member whereby to make the driven member recovered to original position automatically after a cycle of movement;

a cover mounted onto the actuating member and the driven member for making the actuating member, driven member and the paper pusher connected in an interactive manner.

2. The paper dispenser as claimed in claim 1, wherein the chassis consists of a pair of long sides and a pair of short sides, two hole are defined at each of the long sides with corresponding to each other, while at the first end protrusions are formed with corresponding to the holes of the chassis respectively such that the actuating member permitted to move in the chassis.

3. The paper dispenser as claimed in claim 2, wherein two strip grooves are formed at both sides of the chassis respectively with corresponding to each other, while the second end of the driven member horizontally movable in the strip grooves.

4. The paper dispenser as claimed in claim 2, wherein the paper pusher having a pushing portion and at both sides of the pushing portion an arm symmetrically is formed respectively, the pair of arms employed to be engaged with the strip grooves and connected to the second end of the driven member by virtue of a rod.

5. The paper dispenser as claimed in claim 4, wherein a hook is defined at a short side of the chassis, the elastic member has a first end connected to the hook and a second end connected to the rod.

6. The paper dispenser as claimed in claim 1, wherein the elastic member is a spring.

7. The paper dispenser as claimed in claim 5, wherein the elastic member is a spring.

8. The paper dispenser as claimed in claim 4, wherein the paper pusher is provided with a damper at the pushing portion.

9. The paper dispenser as claimed in claim 1, wherein the cover has a chamber, in the chamber a contacting piece is disposed for butting around the center of the actuating member.

10. The paper dispenser as claimed in claim 2, wherein slots are defined at the long sides of the chassis, while with corresponding to which projections are defined at the outer periphery of the cover for prevention of the disengagement of the same from the chassis.

* * * * *